United States Patent [19]

Shaub

[11] 4,101,427

[45] Jul. 18, 1978

[54] LUBRICANT COMPOSITION

[75] Inventor: Harold Shaub, New Providence, N.J.

[73] Assignee: Exxon Research & Engineering Co., Linden, N.J.

[21] Appl. No.: 766,917

[22] Filed: Feb. 9, 1977

[51] Int. Cl.[2] ..... C10M 1/48; C10M 3/42; C10M 5/24; C10M 0/46

[52] U.S. Cl. ..... 252/32.7 E; 252/389 A; 252/400 A

[58] Field of Search ..... 252/32.7 E, 389 A, 400 A

[56] References Cited

U.S. PATENT DOCUMENTS

| | | | |
|---|---|---|---|
| 2,789,952 | 4/1957 | Cantrell et al. | 252/32.7 E |
| 3,017,359 | 1/1962 | Gottshall et al. | 252/32.7 E |
| 3,031,401 | 4/1962 | Thayer | 252/32.7 E |
| 3,103,492 | 9/1963 | Dinsmore et al. | 252/32.7 E |
| 3,682,819 | 8/1972 | Morris et al. | 252/32.7 E |
| 3,826,745 | 7/1974 | Ryer et al. | 252/32.7 E |
| 3,997,454 | 12/1976 | Adams | 252/32.7 E |

*Primary Examiner*—Delbert E. Gantz
*Assistant Examiner*—Irving Vaughn
*Attorney, Agent, or Firm*—Wayne Hoover; Earnest Zagarella

[57] ABSTRACT

The anti-wear and anti-friction properties of a fully formulated lubricating composition containing a zinc dialkyldithiophosphate or a similar metal dialkyldithiophosphate is improved by adding an amine salt of a dialkyldithiophosphate. The amine salt is prepared with a t-alkyl primary amine. The amine salt may be simply added to a formulated composition or used as a substitute for the metal dialkyldithiophosphate which are often included in lubricating compositions.

9 Claims, No Drawings

LUBRICANT COMPOSITION

BACKGROUND OF THE INVENTION

This invention relates to additives for liquid hydrocarbons and to liquid hydrocarbon compositions containing the same. More particularly, this invention relates to additives for lubricating compositions and to lubricating compositions comprising the same.

As is well known, there are many instances, particularly under "Boundary Lubrication" conditions where two rubbing surfaces must be lubricated, or otherwise protected, so as to prevent wear and to ensure continued movement. Moreover, where, as in most cases, friction between the two surfaces will either increase the power required to effect the movement or reduce the recovery efficiency, where the movement is an integral part of an energy conversion system, it is most desirable to effect the lubrication in a manner which will minimize this friction. As is also well known, both wear and friction can be reduced, with various degrees of success, through the addition of a suitable additive or combination thereof, to a natural or synthetic lubricant. Similarly, continued movement can be insured, again with varying degrees of success, through the addition of one or more appropriate additives.

With respect to wear, several suitable additives have been proposed heretofore. In general, these additives function by forming a protective coating on the moving surfaces. Moreover, these additives are, generally, only slightly soluble in the base oil medium and are therefore, easily separated from the oil at the moving surfaces. Generally, the antiwear agent coating is maintained through physical, rather than chemical, bonding.

Extreme pressure agents also form a protective coating on the surface of the moving metal parts thereby preventing metal to metal contact even when the base lubricating oil is effectively squeezed from between the surfaces. These coatings are, however, generally effected through chemical bonding and are, therefore generally more stable than the coatings formed by antiwear agents. Metal dialkyldithiophosphates are, of course, included amongst the list of extreme pressure agents known to be effective in the prior art.

Similarly, antifriction agents or oiliness or lubricity agents as the same are often referred to in the prior art functioned by forming a coating on the surface of the moving metal parts. As in the case of antiwear agents, however, the coating bonds are generally, effected physically, rather then chemically, and the bonding between an antifriction agent and the surface is, generally weaker than the bond formed between an antiwear agent and the metal surface.

As is also well known in the prior art, and as is suggested by the foregoing, antiwear, antifriction and extreme pressure agents, as well as other agents, compete for the surface of the moving metal parts which are subjected to lubrication with a given composition and, indeed, extreme care must, generally, be exercised in the selection of these several agents to ensure compatibility and effectiveness. As is equally well known, several additives which are commonly used in lubricating compositions perform multiple function. As a result, several known compositions will contain more than one additive exhibiting antiwear properties, more than one additive exhibiting antifriction properties and more than one additive exhibiting extreme pressure properties.

Representative of the multifunctional additives are the metal dialkyl dithiophosphates which, among other things, exhibit antioxidant properties and antiwear properties. Of these compounds, the zinc dialkyldithiophosphates are most commonly used in lubricant compositions and, while zinc dialkyldithiophosphate affords excellent oxidation resistance and exhibits superior antiwear properties, the same appears to increase the friction between the moving surfaces. As a result, compositions containing zinc dialkyldithiophosphate as well as other metal dialkyldithiophosphates where the metal forms a relatively hard metal oxide do not offer the most desirable lubricity and, in turn, lead to significant energy losses in overcoming friction even when antifriction agents are included in the composition. Notwithstanding this, however, the zinc dialkyldithiophosphates continue to be used in lubricating compositions because of their good compatibility with other, conventional, additives and because of their antioxidation and antiwear characteristics. Such lubricant compositions do, then, generally, result in higher fuel consumption than is considered particularly desirable, especially in light of the current energy crisis.

In light of the foregoing, then, the need for an improved lubricating composition containing a zinc or similar metal dialkyldithiophosphate that will permit operation of moving parts under boundary conditions with reduced friction is believed to be readily apparent. Similarly, the need for such a composition that can be used without the loss of other desirable lubricant properties is also believed to be readily apparent.

SUMMARY OF THE INVENTION

It has now surprisingly been discovered that the foregoing and other disadvantages of the prior art lubricating additives and the lubricating compositions formulated therewith can be overcome with the additive combination and the lubricating compositions of this invention. It is, then, an object of a first embodiment of this invention to provide antifriction additives which will reduce friction when used in a lubricating oil composition under boundary lubricating conditions. It is another object of this first embodiment of the invention to provide such an additive which can be used in combination with zinc or a similar metal dialkyldithiophosphate and other lubricating additives to provide a lubricating composition which will exhibit acceptable antiwear, extreme pressure, anticorrosion and antioxidation properties.

It is, on the other hand, an object of a second embodiment of this invention to provide an improved lubricating oil composition which can be used under boundary lubricating conditions. It is still another object of this second embodiment of the invention to provide such a composition exhibiting improved antifriction properties. It is a still further object of this second embodiment of the invention to provide such a composition which will, generally, reduce fuel requirements for engines and other equipment having moving parts operated under boundary lubricating conditions. Still further objects will become apparent from the description set forth hereinafter.

In accordance with the present invention, the foregoing and other objects and advantages are accomplished with an antifriction additive consisting of an amine salt of a dialkyldithiophosphate. As indicated more fully, hereinafter, the amine portion of the dialkyldithiophosphate salt will contain a t-alkyl group. Also, the length of the t-alkyl group as well as the length of the alkyl constituents of the dialkyldithiophosphate will be carefully controlled so as to provide the solubility desired for the particular, intended application. As also indicated more fully hereinafter, the antifriction additive of this invention may be used in addition to or partly substituted for the zinc or other metal dialkyldithiophosphate used in the lubricating composition.

DETAILED DESCRIPTION OF THE INVENTION

As previously indicated, the present invention relates to an improved antifriction additive and to lubricating compositions comprising the same in combination with a zinc or similar metal dialkyldithiophosphate. More specifically, the present invention relates to an improved lubricating composition which exhibits improved antifriction characteristics without jeopardizing other essential properties and/or characteristics. As also indicated previously, the lubricating composition of the present invention comprises an amine salt of a dialkyldithiophosphate and a metal dialkyldithiophosphate.

In general, any t-alkyl primary amine salt of a dialkyldithiophosphate could be used in the antifriction additive in the lubricating composition of this invention so long as the same is soluble in the base oil stock. Best results are, however, obtained with such compounds wherein the t-alkyl group contains between about 12 and 22 carbon atoms and wherein each of the alkyl radicals of the dialkyldithiophosphate contain between about 1 and 12 carbon atoms. Suitable amine salts can be represented by the following general formula:

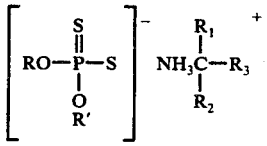

wherein R and R′ may be the same or different hydrocarbon radicals containing from about 1 to about 12 carbon atoms and $R_1$, $R_2$ and $R_3$ may be the same or different alkyl groups containing from about 1 to about 30 carbon atoms. It will, of course, be appreciated that salts of the type illustrated by the foregoing formula can be obtained by first esterifying a dialkyldithiophosphoric acid and then neutralizing the dialkyldithiophosphoric acid ester with a t-alkyl primary amine. $R_1$, $R_2$ and $R_3$ would, then, correspond to the t-alkyl group of the amine and R and R′ would be the hydrocarbon radical or radicals associated with the alcohol or alcohols used.

The metal dialkyldithiophosphates useful in the present invention are salts of dialkyl esters of dialkyldithiophosphoric acids and may be represented generally by the following formula:

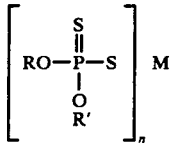

wherein R and R′ may be the same or different hydrocarbon radicals containing between about 1 and 18 carbon atoms; M is a transition metal; and $n$ is the valence of the metal M. As indicated previously, M may be any metal but the advantages of the invention are most pronounced when M is a metal which forms a relatively hard metal oxide and for purposes of this invention a metal oxide will be considered relatively hard if the oxide exhibits a Mohs hardness of about 3 or more. Such metals, then, include zinc, tungsten and the like.

The dialkyldithiophosphates which are useful in the compositions of the present invention may be prepared in accordance with known techniques by first esterifying a dialkyldithiophosphoric acid and then neutralizing the dialkyldithiophosphoric acid ester with a suitable metal salt. In general, any alcohol or mixtures of alcohols containing between about 1 and 18 carbon atoms may be used to effect the esterification The hydrocarbon portion of the alcohol may be either a straight chain alkyl or alkenyl group, or a cyclic, cycloaliphatic or aromatic group. Among the alcohols which are generally preferred for use as starting materials in the preparation of the esters may be mentioned ethyl, isopropyl, amyl, 2-ethylhexyl, lauryl, steryl and methyl cyclohexyl alcohols as well as commercial mixtures of alcohols such as the mixture of alcohols essentially of the $C_{10}$ to $C_{18}$ range derived from coconut oil and known as "Lauryl B" alcohol. Other natural products containing alcohols such as the alcohols derived from wool fat, sperm oil, natural waxes and the like and alcohols produced by the oxidation of petroleum hydrocarbon products, also the oxo-alcohols produced from olefins, carbon monoxide and hydrogen may likewise be employed. Aromatic compounds such as alkylated phenols of the type of n-butyl phenol, tertiary-amyl phenol, diamyl phenol, tertiary octyl phenol, cetyl phenol, petroleum phenol and the like as well as the corresponding naphthols may be employed in like manner.

Following the esterification, the diester is then neutralized with a suitable basic metal compound or a mixture of such compounds. In general, any compound could be used but the oxides, hydroxides and carbonates are most generally employed.

In general, the antifriction additive will be combined in a lubricating composition at a concentration within the range from about 0.1 to about 1.5 gms. per 100 gms. base oil stock and the metal neutralized dialkyldithiophosphate will be added at a concentration within the range from about 0.1 to about 5.0 gms. per 100 grams base oil stock. Moreover, the weight ratio of metal neutralized dialkyldithiophosphate to amine salt will be maintained within the range from about 0.3 to about 20 in such compositions.

Among the liquid hydrocarbons which may be used as base oils are mineral lubricating oils or synthetic lubricating oils. The synthetic oils will include diester oils such as di(2-ethylhexyl) sebacate; complex ester oils such as those formed from dicarboxylic acids, glycols and either monobasic acids or monohydric alcohols; silicone oils; sulfide esters, organic carbonates; and other synthetic oils known to the art. Warming the oil and additive materials may be necessary in order to obtain solution if the additives are solid at normal temperature.

Other additives, of course, may be added to the oil compositions of the present invention to form a finished oil. Such additives include dispersants such as PIBSATEPA, etc., oxidation inhibitors such as phenothiazine or phenyl α-naphthylamine; rust inhibitors such as lecithin or petroleum sulfonates, sorbitan monooleate;

detergents such as the barium phenates; pour point depressants such as copolymers of vinyl acetate with fumaric acid esters of coconut oil alcohols; viscosity index improvers such as olefin copolymers, polymethacrylates; etc.

PREFERRED EMBODIMENT

In a preferred embodiment of the present invention, the amine salt, antifriction additive will be the reaction product of a mixture of t-alkyl primary amines wherein the t-alkyl group has from about 12 to 14 carbon atoms and a di-n-propyl dithiophosphate. Also in a preferred embodiment of the present invention, a zinc dialkyldithiophosphate will be used and the alkyl portions will be either the same or different and either straight chained or branched chained groups containing between about 2 and 8 carbon atoms. In a most preferred embodiment, the alkyl portions will be provided through esterification with a mixture of $C_4$ and $C_5$ alcohols.

In a preferred lubricating composition, the amine salt and the zinc neutralized dialkyldithiophosphate will be combined with a mineral oil suitable for use as a lubricant in an internal combustion engine. In the preferred composition the amine salt will be added at a concentration ranging between about 0.1 and 1.0 gms. per 100 grams of base oil while the zinc neutralized dialkyldithiophosphate will be added at a concentration within the range from about 0.5 to about 1.5 gms. per 100 grams of base oil. In a most preferred composition, the lubricant will be fully formulated and contain an oxidation inhibitor, a rust inhibitor, a detergent, a dispersant, a pour point depressant and a viscosity index improver.

The invention will be further understood by reference to the following examples which illustrate a preferred form of the invention and compares the same with different, though similar compositions.

EXAMPLE 1

In this example, four formulations were prepared in a 10 W-40 SE quality automotive engine oil and the relative wear and friction were then determined with a ball on cylinder test. The apparatus used in the ball on cylinder test is described in the Journal of the American Society of Lubrication Engineers, entitled "ASLE Transactions" vol. 4, pages 1–11, 1961. In essence, the apparatus consists basically of a fixed metal ball loaded against a rotating cylinder. The weight on the ball and the rotation of the cylinder can be varied during any given test or from test to test. Also, the time of any given test can be varied. Generally, however, steel on steel is used at a constant load, a constant rpm and a fixed time and in each of the tests of this example, a 4Kg load, 0.26 rpm and 70 minutes was used. The actual wear was determined by measuring the volume of metal removed from the cylinder and then placed on a relative basis by ratioing the wear actually obtained against a standard. The actual friction, on the other hand, was determined from the power actually required to effect rotation and the relative friction determined by ratioing the actual load to that of a standard. The apparatus and method used is more fully described in U.S. Pat. No. 3,129,580, which was issued May 21, 1964 to Furey et al and which is entitled "Apparatus for Measuring Friction and Contacts between Sliding Lubricating Surfaces."

In this example, the standard was a 10-W-40 SE quality automotive engine oil containing a dispersant, a rust inhibitor, a detergent, an oxidation inhibitor and a V.I. improver and a zinc dialkyldithiophosphate in which the alkyl groups were a mixture of such groups having between about 4 and 5 carbon atoms. The wear and friction of this composition were then determined and assigned a relative value of 1.00.

In a second composition, the same formulated 10W-40 SE quality autmotive engine oil was used but 0.1 wt. % of an amine salt prepared by neutralizing a di-n-propyl dithiophosphate with a mixture of $C_{12}$, $C_{13}$ and $C_{14}$ t-alkyl primary amines was added. This mixture is designated Primene 81R by Rohm and Haas Company. The composition of which is described in their brochure on t-alkyl primary amines. After formulation, the wear and friction were determined and, on a relative basis were 1.00 and 0.82 respectively.

In a third composition, the same formulated 10W-40 SE quality automotive engine oil used in the first two compositions was used and 0.5 wt. % of the amine salt used in the second composition was used. The wear and friction exhibited by this composition, on a relative basis, were 1.0 and 0.72, respectively.

The fourth composition tested in this example was identical to the second and third compositions except that 1.0 wt. % of the amine salt was used. After formulation, the wear and friction were again determined in the same manner as that previously described and were found to be 0.90 and 0.62, respectively.

From the foregoing, it should be readily apparent that the addition of a t-alkyl primary amine salt of a dialkyldithiophosphate to a fully formulated 10W-40 SE quality automotive engine oil containing a zinc dialkyldithiophosphate significantly improves friction.

EXAMPLE 2

In this example, the friction of two lubricating compositions was determined with a ball on cylinder test with a load of 4 Kg, a temperature of 220° F., 0.26 rpm and a period of 70 minutes. In each formulation, a solvent 150 Neutral, low pour base oil was used and the base oil without additives was assigned a relative friction of 1.

In the first composition, 0.1 wt. % of an amine salt identical to that used in Example 1 was added to the base oil. The relative friction was then found to be 0.8.

In a second formulation, 0.5 wt. % of an amine salt identical to that used in Example 1 was added to the base oil. The relative friction of this composition was 0.51.

From the foregoing, it is clear that the friction of an unformulated base oil is significantly reduced when a t-alkyl primary amine salt of a dialkyldithiophosphate is added thereto.

EXAMPLE 3

In this example the relative wear and friction of two additional fully formulated 10W-40 SE quality automotive engine oils containing an amine salt identical to that used in Example 1 was determined in the same manner as described in Example 1. The 10W-40 SE quality automotive engine oil was identical to that used in Example 1 except that in the first composition, the oil contained 0.67 times the amount of zinc dialkyldithiophosphate and in the second composition, the oil contained 0.5 times the amount of zinc dialkyldithiophosphate. Both compositions contained 1 wt. % of an amine salt identical to that used in Example 1. The relative friction and wear of the first composition were 0.58 and 0.54, respectively, while the relative friction and wear of the second composition were 0.55 and 0.34, respectively.

From the foregoing, it is clear that reducing the zinc dialkyldithiophosphate content in these formulations aids rather than harms the wear protecting properties of these formulations. This is perhaps due to competition for the metal surface between the amine salt and the zinc dialkyldithiophosphate, the amine salt providing the better friction and wear protection.

Having thus described and illustrated the invention what is claimed is:

1. A lubricating composition having improved anti-friction properties comprising a base oil and an additive mixture of from about 0.1 to about 1.5 grams of t-alkyl primary amine salt of dialkyldithiophosphate per 100 grams of base oil and from about 0.1 to about 5.0 grams, per 100 grams of base oil, of a metal dialkyldithiophosphate wherein said metal is a transition metal and the oxide of said metal exhibits a Mohs hardness of about 3 or more.

2. The composition of claim 1 wherein the alkyl groups in said t-alkyl primary amine salt contain from about 1 to about 30 carbon atoms and the alkyl groups in the dialkyldithiophosphate portion of said amine salt contain from about 1 to about 12 carbon atoms.

3. The composition of claim 2 wherein the alkyl groups in said metal dialkyldithiophosphate contain from about 1 to about 18 carbon atoms.

4. The composition of claim 3 wherein said metal dialkyldithiophosphate is zinc dialkyldithiophosphate.

5. The composition of claim 4 wherein the t-alkyl group of the amine contains from about 12 to about 22 carbon atoms.

6. The composition of claim 4 wherein from about 0.1 to about 1.0 grams of t-alkyl primary amine salt of dialkyldithiophosphate per 100 grams of base oil and from about 0.5 to about 1.5 grams of the metal dialkyldithiophosphate per 100 grams of base oil are present.

7. The composition of claim 5 wherein said t-alkyl primary amine salt is a salt of di-n-propyl dithiophosphate.

8. The composition of claim 7 wherein the t-alkyl group of the amine contains between about 12 and 14 carbon atoms.

9. The composition of claim 8 wherein the amine salt is prepared with a mixture of t-alkyl primary amines.

* * * * *